US007592277B2

(12) United States Patent
Andrady et al.

(10) Patent No.: US 7,592,277 B2
(45) Date of Patent: Sep. 22, 2009

(54) NANOFIBER MATS AND PRODUCTION METHODS THEREOF

(75) Inventors: Anthony L. Andrady, Apex, NC (US); David S. Ensor, Chapel Hill, NC (US); Teri A. Walker, Durham, NC (US); Purva Prabhu, Morrisville, NC (US)

(73) Assignee: Research Triangle Institute, Research Triangle Park, NC (US)

( * ) Notice: Subject to any disclaimer, the term of this patent is extended or adjusted under 35 U.S.C. 154(b) by 431 days.

(21) Appl. No.: 11/130,269

(22) Filed: May 17, 2005

(65) Prior Publication Data

US 2006/0264140 A1 Nov. 23, 2006

(51) Int. Cl.

| | |
|---|---|
| ***D04H 1/00*** | (2006.01) |
| ***D04H 13/00*** | (2006.01) |
| ***D04H 3/00*** | (2006.01) |
| ***D04H 5/00*** | (2006.01) |

(52) U.S. Cl. ..... 442/340; 442/327; 442/341; 442/350; 442/351; 442/401; 442/381; 442/382; 442/409; 442/411; 442/414; 442/415; 442/417; 428/357; 428/364; 428/365; 428/401

(58) Field of Classification Search ..... 442/340, 442/327, 341, 350, 351, 401, 414, 381–382, 442/393, 415, 417, 409, 411; 428/357, 364, 428/365, 401; 425/174.8 E; 264/10, 465
See application file for complete search history.

(56) References Cited

U.S. PATENT DOCUMENTS

| | | | |
|---|---|---|---|
| 705,691 | A | 7/1902 | Morton |
| 1,975,504 | A | 10/1934 | Formhals |
| 2,048,651 | A | 7/1936 | Norton |
| 2,160,962 | A | 6/1939 | Formhals |
| 2,187,306 | A | 1/1940 | Formhals |
| 2,323,025 | A | 6/1943 | Formhals |
| 2,349,950 | A | 5/1944 | Formhals |
| 3,280,229 | A | 10/1966 | Simons |
| 3,475,198 | A | 10/1969 | Drum |
| 3,490,115 | A | 1/1970 | Owens et al. |
| 3,670,486 | A | 6/1972 | Murray, Jr. |
| 3,901,012 | A | 8/1975 | Safar |

(Continued)

FOREIGN PATENT DOCUMENTS

| | | |
|---|---|---|
| EP | 1 217 107 A1 | 6/2002 |

(Continued)

*Primary Examiner*—Norca L Torres-Velazquez
(74) *Attorney, Agent, or Firm*—Oblon, Spivak, McClelland, Maier & Neustadt, L.L.P.

(57) ABSTRACT

An apparatus and method in which the apparatus includes a first electrospinning device configured to electrospin first fibers of a first substance, a second electrospinning device configured to electrospin second fibers of a second substance such that first and second fibers combine in a mat formation region, and a biasing device configured to bias the first electrospinning device with a first electric polarity and to bias the second electrospinning device with a second electric polarity of opposite polarity to the first electric polarity to promote attraction and coalescence between the first and second fibers. The method electrospins under the first electric polarity first fibers from the first substance, electrospins under the second electric polarity fibers from the second substance, and coalesces the first and second fibers to form the fiber mat.

36 Claims, 12 Drawing Sheets

U.S. PATENT DOCUMENTS

| | | | |
|---|---|---|---|
| 3,994,258 | A | 11/1976 | Simm |
| 4,044,404 | A | 8/1977 | Martin et al. |
| 4,127,706 | A | 11/1978 | Martin et al. |
| 4,230,650 | A | 10/1980 | Guignard |
| 4,323,525 | A | 4/1982 | Bornat |
| 4,345,414 | A | 8/1982 | Bornat et al. |
| 4,468,922 | A | 9/1984 | McCrady et al. |
| 4,552,707 | A | 11/1985 | How |
| 4,618,524 | A | 10/1986 | Groitzsch et al. |
| 4,689,186 | A | 8/1987 | Bornat |
| 4,878,908 | A | 11/1989 | Martin et al. |
| 4,965,110 | A | 10/1990 | Berry |
| 5,024,789 | A | 6/1991 | Berry |
| 5,088,807 | A | 2/1992 | Waters et al. |
| 5,522,879 | A | 6/1996 | Scopelianos |
| 5,866,217 | A | 2/1999 | Stenoien et al. |
| 6,099,960 | A | 8/2000 | Tennent et al. |
| 6,106,913 | A | 8/2000 | Scardino et al. |
| 6,110,590 | A | 8/2000 | Zarkoob et al. |
| 6,265,333 | B1 | 7/2001 | Dzenis et al. |
| 6,265,466 | B1 | 7/2001 | Glatkowski et al. |
| 6,306,424 | B1 | 10/2001 | Vyakarnam et al. |
| 6,308,509 | B1 | 10/2001 | Scardino et al. |
| 6,375,886 | B1 | 4/2002 | Angadjivand et al. |
| 6,382,526 | B1 | 5/2002 | Reneker et al. |
| 6,395,046 | B1 | 5/2002 | Emig et al. |
| 6,486,379 | B1 | 11/2002 | Chen et al. |
| 6,492,574 | B1 | 12/2002 | Chen et al. |
| 6,520,425 | B1 | 2/2003 | Reneker |
| 6,554,881 | B1 | 4/2003 | Healey |
| 6,558,422 | B1 | 5/2003 | Baker et al. |
| 6,673,136 | B2 | 1/2004 | Gillingham et al. |
| 6,753,454 | B1 | 6/2004 | Smith et al. |
| 2001/0045547 | A1 | 11/2001 | Senecal et al. |
| 2002/0007869 | A1 | 1/2002 | Pui et al. |
| 2002/0042128 | A1 | 4/2002 | Bowlin et al. |
| 2002/0084178 | A1 | 7/2002 | Dubson et al. |
| 2002/0090725 | A1 | 7/2002 | Simpson et al. |
| 2002/0100725 | A1 | 8/2002 | Lee et al. |
| 2002/0122840 | A1 | 9/2002 | Lee et al. |
| 2002/0124953 | A1 | 9/2002 | Sennett et al. |
| 2002/0128680 | A1 | 9/2002 | Pavlovic |
| 2002/0150669 | A1 | 10/2002 | Pui et al. |
| 2002/0173213 | A1 | 11/2002 | Chu et al. |
| 2002/0175449 | A1 | 11/2002 | Chu et al. |
| 2003/0017208 | A1 | 1/2003 | Ignatious et al. |
| 2003/0054035 | A1 | 3/2003 | Chu et al. |
| 2003/0100944 | A1 | 5/2003 | Laksin et al. |
| 2003/0106294 | A1 | 6/2003 | Chung et al. |
| 2003/0190383 | A1 | 10/2003 | Kim |
| 2006/0094320 | A1 * | 5/2006 | Chen et al. ..... 442/340 |

FOREIGN PATENT DOCUMENTS

| | | | |
|---|---|---|---|
| EP | 1 226 795 | A2 | 7/2002 |
| EP | 1 277 857 | A1 | 1/2003 |
| JP | 2002-201559 | | 7/2002 |
| JP | 2002-249966 | | 9/2002 |
| KR | 2004083573 | | 10/2004 |
| WO | WO 98/03267 | | 1/1998 |
| WO | WO 01/15754 | A1 | 3/2001 |
| WO | WO 01/26610 | A1 | 4/2001 |
| WO | WO 01/26702 | A2 | 4/2001 |
| WO | WO 01/27365 | A1 | 4/2001 |
| WO | WO 01/27368 | A1 | 4/2001 |
| WO | WO 01/51690 | A1 | 7/2001 |
| WO | WO 01/68228 | A1 | 9/2001 |
| WO | WO 01/74431 | A2 | 10/2001 |
| WO | WO 01/89022 | A1 | 11/2001 |
| WO | WO 01/89023 | A1 | 11/2001 |
| WO | WO 02/16680 | A1 | 2/2002 |
| WO | WO 02/34986 | A2 | 5/2002 |
| WO | WO 02/49535 | A2 | 6/2002 |
| WO | WO 02/49536 | A2 | 6/2002 |
| WO | WO 02/49678 | A2 | 6/2002 |
| WO | WO 02/074189 | A2 | 6/2002 |
| WO | WO 02/072937 | A1 | 9/2002 |
| WO | WO 02/074191 | A2 | 9/2002 |
| WO | WO 02/092339 | A1 | 11/2002 |
| WO | WO 02/092888 | A1 | 11/2002 |
| WO | WO 03/004735 | A1 | 1/2003 |

* cited by examiner

NANOFIBER MATS AND PRODUCTION METHODS THEREOF

CROSS-REFERENCE TO RELATED APPLICATIONS

This application is related to U.S. Patent Publication No. 2005/0224998, filed as U.S. application Ser. No. 10/819,942, on Apr. 8, 2004, entitled "Electrospray/Electrospinning Apparatus and Method," the entire contents of which are incorporated herein by reference. This application is related to U.S. Patent Publication No. 2005/02249999, filed as U.S. application Ser. No. 10/819,945, on Apr. 8, 2004, entitled "Electrospinning in a Controlled Gaseous Environment," the entire contents of which are incorporated herein by reference. This application is related to U.S. Patent Publication No. 2006/0228435, filed as U.S. application Ser. No. 10/819,916, on Apr. 8, 2004, entitled "Electrospinning of Fibers Using a Rotating Spray Head," the entire contents of which are incorporated herein by reference.

BACKGROUND OF THE INVENTION

1. Field of the Invention

This invention relates to the field of fiber mats including multicomponent fiber mats and processes of forming such mats.

2. Description of the Related Art

Fibers and nanofibers are finding new applications in the pharmaceutical, filter, catalysts, clothing, and medical industries. Techniques such as electrospinning have been used to form fibers and nanofibers. For example, electrospinning techniques have been used to form fibers as small as a few nanometers in a principal direction. The phenomenon of electrospinning involves the formation of a droplet of polymer at an end of a needle, the electric charging of that droplet in an applied electric field, and an extraction of the polymer material from the droplet into the environment about the tip such as to draw a fiber of the polymer material from the tip.

Glass fibers have been manufactured in a sub-micron range for some time. Small micron diameter fibers have been manufactured and used commercially for air filtration applications for more than twenty years. Polymeric melt blown fibers have recently been produced with diameters less than a micron. Several value-added nonwoven applications, including filtration, barrier fabrics, wipes, personal care, medical and pharmaceutical applications may benefit from the interesting technical properties of nanofibers and nanofiber webs. Electrospun nanofibers have a dimension less than 1 μm in one direction and preferably a dimension less than 100 nm in this direction. Nanofiber webs have typically been applied onto various substrates selected to provide appropriate mechanical properties and to provide complementary functionality to the nanofiber web. In the case of nanofiber filter media, substrates have been selected for pleating, filter fabrication, durability in use, and filter cleaning considerations, as described in U.S. Pat. No. 6,673,136, the entire contents of which are incorporated herein by reference.

Conventional techniques for electrospinning produce mats of fibers or nanofibers having a uniform chemical composition throughout the mat. Even if the electrospin medium (i.e., the liquid or dissolved polymer) is a mix of various polymers, the fibers produced would have a uniform composition at any given location in the resultant fiber mat, i.e., the composition at any point being determined by the polymer constituency at the time of electrospinning. In addition, the conventional electrospinnning techniques produce fibers of a uniform fiber thickness at any point in the resultant fiber mat, as factors preset on the electrospinning device such as for example the electric field strength and the drying rate determine the fiber thickness produced.

Recently, Smith et al in U.S. Pat. No. 6,753,454, the entire contents of which are incorporated herein by reference, describe a technique for electrospinning fibers simultaneously or sequentially from multiple polymer-containing reservoirs. In this technique, the reservoirs for electrospinning were connected via a switch to a common power supply generating the requisite electric field by which the fibers are electrospun. As such, the fibers electrospun from the separate reservoirs collect onto a common ground electrode. Smith et al describe one utility of an alloyed fiber mat in the field of medical dressings where one side of the fiber composite is predominantly a set of hydrophilic fibers and the other side is predominantly a set of hydrophobic fibers. Smith et al also describe a polymer membrane forming the medical dressing that is generally formulated from a plurality of fibers electrospun from a substantially homogeneous mixture of any of a variety of hydrophilic and at least weakly hydrophobic polymers, that can be optionally blended with any of a number of medically important wound treatments, including analgesics and other pharmaceutical or therapeutical additives. For example, Smith et al describe polymeric materials suitable for electrospinning into fibers that may include absorbable and/or biodegradable polymeric substances that react with selected organic or aqueous solvents, or that dry quickly. Smith et al also describe that essentially any organic or aqueous soluble polymer or any dispersions of such polymer with a soluble or insoluble additive suitable for topical therapeutic treatment of a wound may be employed.

A schematic representation of the apparatus of Smith et al is shown in FIG. 1. FIG. 1 depicts an electrospinning apparatus 10 for the production of a fiber mat. The term "fiber mat" is used to define a plurality of fibers formed by forming fiber after fiber on each other. Respective fibers in the fiber mat can intermingle or be separate from other fibers in the fiber mat. Conventionally, the electrospinning apparatus 10 produces fibers that weakly adhere to each other.

The electrospinning apparatus shown in FIG. 1 is capable of producing fiber mats from separate electrospinning devices. The electrospinning apparatus 10 has two electrospinning devices 10*a* and 10*b* that each produces a same electric field 12 that extracts a polymer melt or solution 14 extruded from a tip 16 of an extrusion element 18 to a collection electrode 20. An enclosure/syringe 22 stores the polymer solutions 14 in each of the electrospinning devices 10*a* and 10*b*. A voltage power source 24 is electrically connected with one electrode through a wire 26 to each of the electrospinning devices 10*a* and 10*b*, and the other electrode of the power source 24 is electrically connected to ground. A switch 25 connects either of the electrospinning devices 10*a* and 10*b* to the power supply 24. The electric field 12 created between the tip 16 and the collection electrode 20 causes the polymer solution 14 to overcome cohesive forces that hold the polymer solution together. A jet of the substance 14 is drawn from the tip 16 toward the collection electrode 20 by the electric field 12 (i.e., electric field extracted), and dries during flight from the extrusion element 18 to the collection electrode 20 in a fiber extraction region 27 to form polymeric fibers, which can be collected downstream on the collection electrode 20.

However, fibers produced from the apparatus in FIG. 1 can suffer from poor adherence among the fibers that constitute the fiber mat due to the electrospun substances having the same electric polarities which in turn results in the collected fibers being repelled from each other as the fibers coalesce together on the collection electrode 20.

SUMMARY OF THE INVENTION

One object of the present invention is to provide apparatuses and methods for producing fiber mats.

Another object of the present invention is to provide fiber mats having an intermixed region of first and second fibers.

Another object of the present invention is to provide a fiber mat having first fibers with a first diameter and second fibers with a second diameter different than the first diameter.

Another object of the present invention is to provide a fiber mat having first fibers made of a first material and second fibers made of a second material.

According to one aspect of the present invention, there is provided a novel apparatus that includes a first electrospinning device configured to electrospin first fibers of a first substance, a second electrospinning device configured to electrospin second fibers of a second substance, and a biasing device configured to bias the first electrospinning device with a first electric polarity and to bias the second electrospinning device with a second electric polarity of opposite polarity to the first electric polarity to promote attraction and coalescence between the first and second fibers such that first and second fibers combine in a mat formation region.

According to a second aspect of the present invention, there is provided a novel method for producing the fiber mat, the method includes electrospinning under the first electric polarity fibers from the first substance, electrospinning under the second electric polarity fibers from the second substance, and coalescing the first and second fibers to form the fiber mat.

According to a third aspect of the present invention, there is provided a novel mat of fibers, the mat having a plurality of first and second fibers intermixed therein; having a cross section fiber density of at least $(2.5\times10^{13})/d^2$ fibers/cm$^2$, where a value of d is given in nm, less than 500 nm, and represents an average diameter d along a length of one fiber of the plurality of first and second fibers.

According to a fourth aspect of the present invention, there is provided a novel composite fiber mat that includes at least one of first and second fibers, and particles directly attached to a surface of the at least one of the first and second fibers along a longitudinal direction of the fibers, the particles being attached by a fiber material of the at least one of the first and second fibers.

It is to be understood that both the foregoing general description of the invention and the following detailed description are exemplary, but are not restrictive of the invention.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
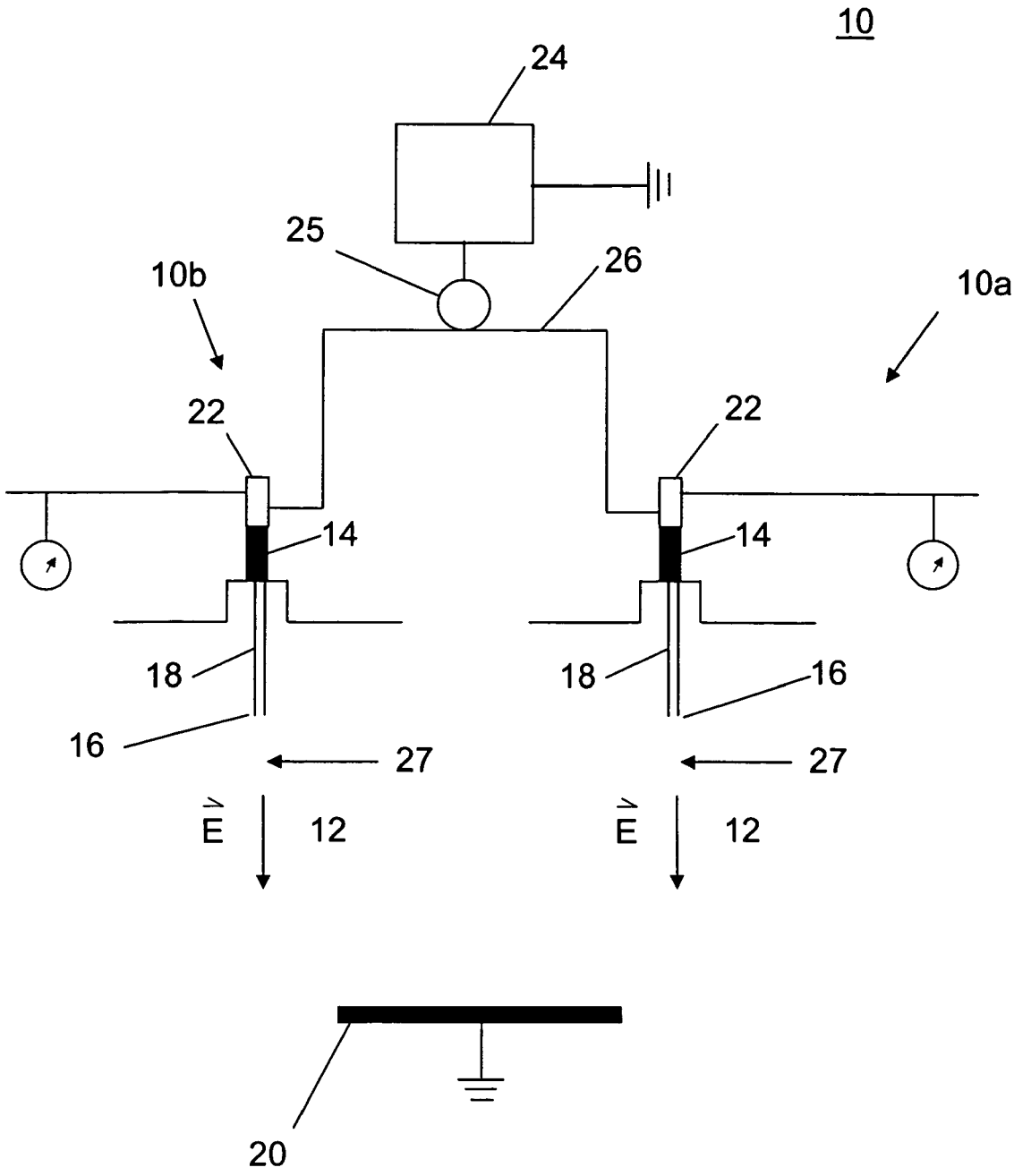
FIG. 1 is a schematic illustration of a conventional electrospinning apparatus.

Referring now to the drawings, wherein like reference numerals designate identical or corresponding parts throughout the several views, and more particularly to FIG. 1, the inventors of the present invention have determined that one effect of the poor adherence between fibers formed in the apparatus of FIG. 1 is that the fiber web tends to break into smaller parts. One factor contributing to the poor adherence derives from the use of a common potential supply provided by a power supply 24. The inventors of the present invention have discovered that the above deficiencies can be overcome if fibers of the fiber web are collected in a state where the fibers have opposite electrical charges on respective fibers in the web. Thus, in one embodiment of the present invention, two electrospinning devices (i.e., a first electrospinning device and a second electrospinning device) are operated at opposite electrical polarities. As a result, the respective electrospun fibers have opposite charge and electrostatically attract to each other in a mat formation region.

Figure 2:
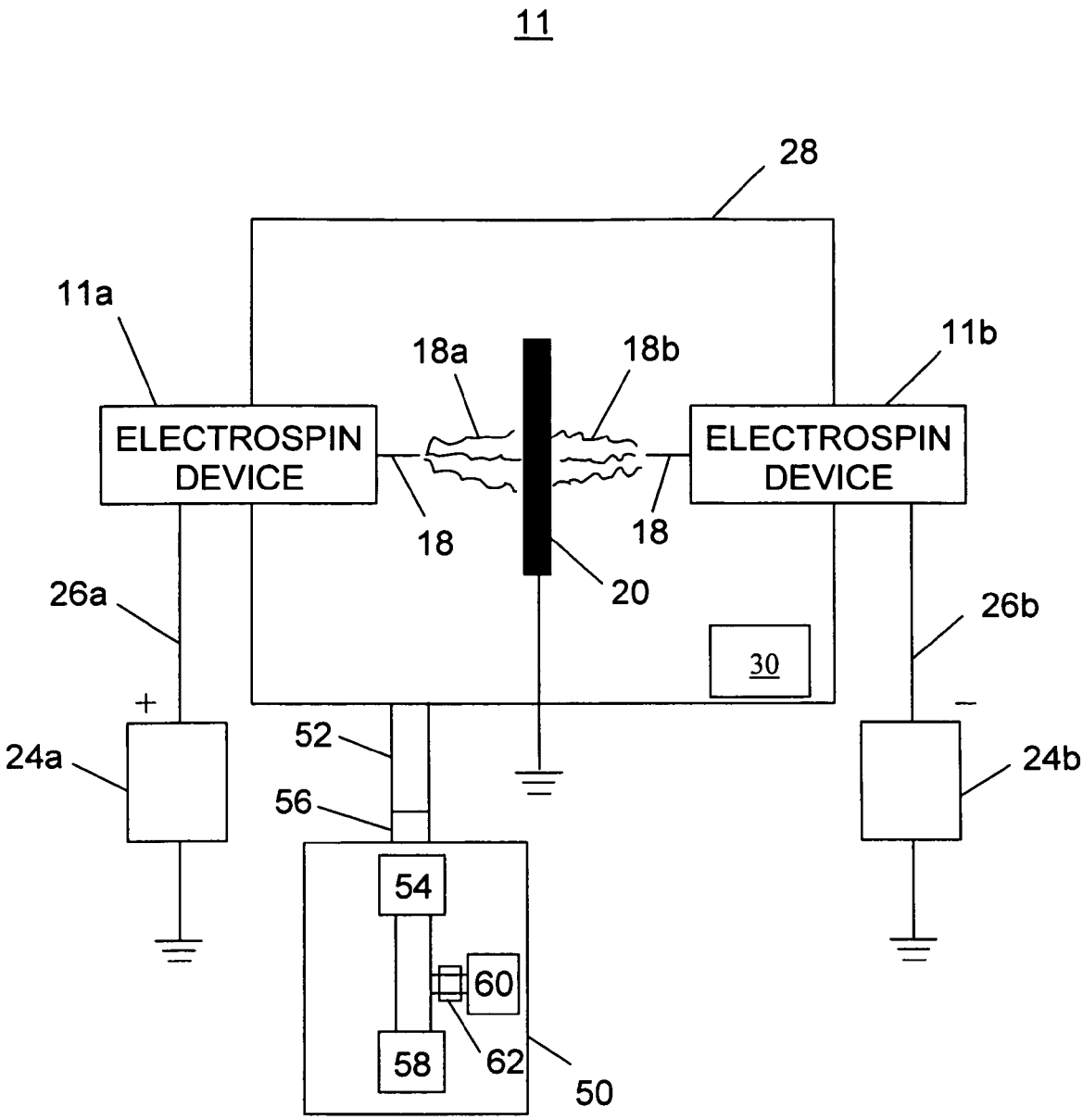
FIG. 2 is a schematic illustration of a dual electrospinning apparatus having horizontal extrusion elements according to one embodiment of the present invention.

Thus, in one embodiment of the present invention, the apparatus 11 shown in FIG. 2 includes at least two electrospinning devices 11*a* and 11*b*. The apparatus 11 is a plural electrospinning apparatus and is configured to produce a fiber mat formed of fibers with different components. The electrospinning devices 11*a* and 11*b* can be any known electrospinning device having the requisite opposite biases applied. The electrospinning devices 11*a* and 11*b* are disposed in one embodiment of the present invention opposite to each other with an optional collection electrode 20 provided between the electrospinning devices 11*a* and 11*b*. In addition, the electrospinning device 11*a* can be connected to a first high voltage power source 24*a* through a wire 26*a* with the power source 24*a* grounded. Similarly, the electrospinning device 11*b* can be connected to a second high voltage power source 24*b* through a wire 26*b* with the power source 24*b* grounded. The substance electrospun from the electrospinning devices 11*a* and 11*b* becomes fibers in corresponding fiber formation regions 18*a* and 18*b* and those fibers coalesce in a mat formation region that could be defined by the collection electrode 20, if present. If an impermeable collection electrode is not present, the fibers attract to each other and collect into a mat in a region where the resultant electric potential is zero. The collection electrode can have any orientation that is suitable to collect the fibers and has a shape selected to match a desired shape of the fiber mat. Exemplary shapes of the collection electrode 20 include but are not limited to a hook, a ring, a web, and/or a net.

The formation of the fiber mat is described in an illustrative example with reference to the apparatus in FIG. 2, which is not intended to limit the present invention. Both electrospinning devices 11*a* and 11*b* of FIG. 2 simultaneously extrude respective electrospin mediums 14. The electrospin mediums 14 used in each of the devices 1*a* and 11*b* are different for the purpose of the present example. After the electrospin mediums 14 are extruded from the extrusion elements 18*a* and 18*b*, the electrospun substances travel towards each other and electrostatically attract to each other due to the opposite electrical charges of the fibers. Upon contact, the fibers remain attached and collected by the collection electrode, if present. By grounding the collection electrode 20, the charged fibers would be not only electrostatically attracted to each other but also attracted to the collection electrode 20.

The two power sources 24*a* and 24*b* could be identical or different. The power sources independently control an electric potential of each of the electrospinning devices 11*a* and 11*b*. The power sources 24*a* and 24*b* are configured to provide opposite polarities to the devices 11*a* and 11*b*. The power sources are configured with the apparatus geometry to supply an electric field strength of 10,000 to 500,000 V/m In such a configuration, the fibers produced by the electrospinning device 11*a* are extruded towards the fibers produced by the electrospinning device 11*b*. When the fibers from the two devices are attracted to and collide with each other, for example due to the opposite electric charges on the respective fibers, the fibers form a fiber mat having fibers, according to one aspect of the invention, with a high fiber-to-fiber adherence as well as a high degree of interpenetration.

Figure 3:
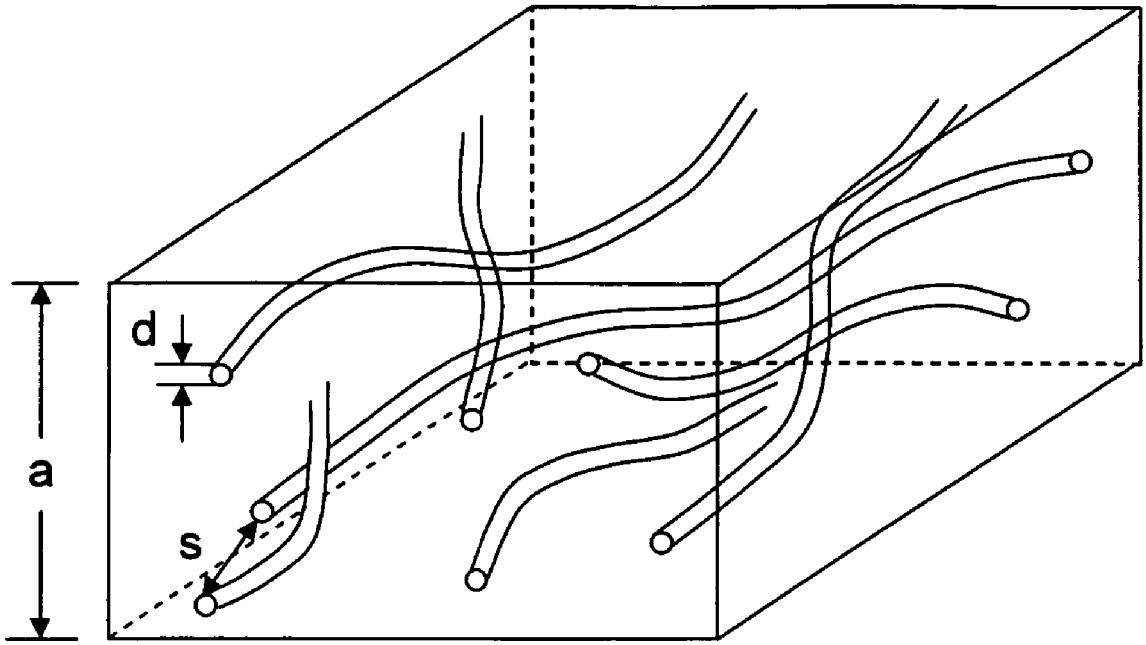
FIG. 3 is a schematic illustration of a fiber distribution according to one embodiment of the present invention.

In one embodiment of the present invention the fibers extruded from the first and second electrospinning devices can have an average diameter of less than 500 nm, preferably less than 100 nm. Larger diameter fibers such as fibers less than 5 μm can also be electrospun in the present invention. An average separation of adjacent fibers in the fiber mat can be less than an average diameter of the fibers, preferably less than half of an average diameter of the fibers. Further, a cross sectional density of the fibers per $cm^2$ is calculated as a function of various parameters. For example, the cross sectional density is calculated with reference to FIG. 3, by dividing a length "a" of a side of a cube (which represents a region of the mat) by a sum of (i) an average diameter "d" of the fibers in the fiber mat, and (ii) an average separation of adjacent fibers "s" (i.e., the distance between two adjacent outer fiber surfaces, as shown in FIG. 3). Further, the quantity obtained is squared to obtain the cross sectional density over a side surface of the cube.

FIG. 3 depicts various individual fibers not yet coalesced into a fiber mat. Using conventional electrospinning, as described previously by Smith et al, the fibers retain common, like charge and tend to be repulsive, thus not densely coalescing. As such, the fibers tend to contact infrequently at points along lengths of the fiber. By contrast, according to the present invention, the fibers have opposite charge and thus attract. Hence, the separation "s" between fibers in the mat of the present invention is smaller, yielding a denser network of coalesced fibers. For example, if the length a of the side of the cube is considered to be 1 cm, and the average separation s is considered to be equal to or approximate to the average diameter d of the fibers, then the cross section density will vary with the average diameter d of the fibers in a cross section of the mat, and will have a value equal to at least $(2.5\times10^{13})/d^2$ fibers/$cm^2$, where a value of d is given in nm. Moreover, the inventors have found that the mat produced can have an average separation smaller than the average diameter of the fibers, and thus the cross section density above calculated represents only one value in a range of cross section density that could be achieved with the present invention. The inventors of the present invention have also found that the average separation distance s between adjacent fibers can be as small as 10 nm. Observed fiber mats regions showing the compactness of the fibers (due to the electrostatic attraction) are shown and discussed later with regard to FIG. 5B.

Indeed, while the criterion of $(2.5\times10^{13})/d^2$ fibers/$cm^2$ is realized in one embodiment of the present invention, utilizing the electrospinning devices 11*a* and 11*b* of the present invention, the present invention is not limited to only this density criterion. For example, the density criterion of $(2.5\times10^{13})/d^2$ fibers/$cm^2$ will scale with the average separation distance s obtained by electrospinning the materials of opposite polarity, which in the present invention depending on various factors such as the fiber materials, fiber diameters, applied bias, etc. can range from a separation distance of 10×d to a value of 1/10×d, and can include all values in between.

In another embodiment of the present invention, the fibers coalesce in a region where the first and second electrospun substances include a solvent content. The region includes a mat formation region where the solvent content of the electrospun substances is less than 10 weight % and/or a mat formation region where the solvent content is greater than 20 weight % depending on the polymer and other conditions under which electrospinning is being carried out. If the solvent content is less than 10 weight %, then minimal or no consolidation appears among the fibers that coalesce. On the contrary, if the solvent content is greater than 20 weight %, the fibers coalesce and consolidate together. Preferably, the regions have the solvent content less than 2 weight % to prevent consolidation and a solvent content greater of 30 weight % to promote consolidation.

In another embodiment of the present invention, the fibers of opposite polarities can collide with each other in a fiber formation region where evaporation of a solvent and consolidation of the electrospun substance into fibers is not complete, thus providing a mechanism for consolidation of the fibers at or along junctions between the opposite polarity fibers.

In one embodiment of the present invention, the collection electrode is disposed below the electrospinning devices 11*a* and 11*b*. In another embodiment, a chamber or enclosure 28 is provided around the region in which the various fibers collide with each other to control a gaseous environment as disclosed in U.S. application Ser. No. 10/819,945.

Figure 4:
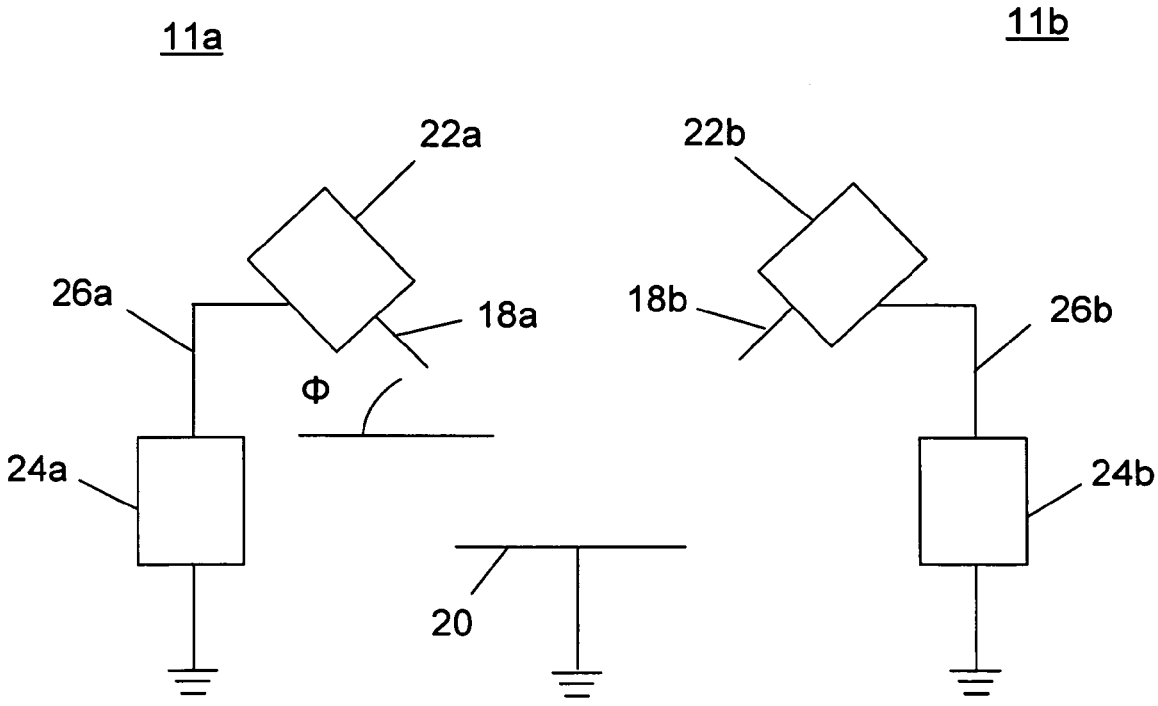
FIG. 4 is a schematic illustration of a dual electrospinning apparatus of one embodiment of the present invention having extrusion elements forming a predetermined angle from vertical direction.

According to the present invention, any arrangement of at least two electrospinning devices that (i) produce fibers charged with electric charges having an opposite polarity and (ii) electrospin the fibers such that the electrospun fibers are capable of electrostatically attracting each other to produce the fiber mat of the present invention. Indeed, FIG. 4 shows another embodiment of the present invention having at least two electrospinning devices 11*a* and 11*b* that produce fiber mats having the properties described above. FIG. 4 shows that the substances electrospun by the extrusion elements 18*a* and 18*b* are directed to each other under a predetermined angle Φ from a horizontal direction such that the drying fibers electrostatically attract to each other to form the fiber mat. As previously discussed, the collection electrode 20 can optionally be provided to collect the fiber mat.

A distance from each extrusion element of the electrospinning devices 11*a* and 11*b* to the collection electrode 20 is preferably in a range between 5 and 50 cm, but the distance depends on a temperature of the ambient, on the properties of the polymer substance extruded, and the drying rate of the extruded substance, as would be known by those skilled in the art.

The composition of the fibers electrospun from the electrospinning devices 11*a* and 11*b* could be identical or different. If different materials are used for the substance of each device, the fiber mat can have a chemical composition that varies along a length of the fiber mat. Further, the average diameter of the fibers electrospun from the electrospinning devices 11*a* and 11*b* could be identical or different.

The fibers and nanofibers produced by the present invention include, but are not limited to, acrylonitrile/butadiene copolymer, cellulose, cellulose acetate, chitosan, collagen, DNA, fibrinogen, fibronectin, nylon, poly(acrylic acid), poly (chloro styrene), poly(dimethyl siloxane), poly(ether imide), poly(ether sulfone), poly(ethyl acrylate), poly(ethyl vinyl acetate), poly(ethyl-co-vinyl acetate), poly(ethylene oxide), poly(ethylene terephthalate), poly(lactic acid-co-glycolic acid), poly(methacrylic acid) salt, poly(methyl methacrylate), poly(methyl styrene), poly(styrene sulfonic acid) salt, poly(styrene sulfonyl fluoride), poly(styrene-co-acrylonitrile), poly(styrene-co-butadiene), poly(styrene-co-divinyl benzene), poly(vinyl acetate), poly(vinyl alcohol), poly(vinyl chloride), poly(vinylidene fluoride), polyacrylamide, polyacrylonitrile, polyamide, polyaniline, polybenzimidazole, polycaprolactone, polycarbonate, polydimethylsiloxane-co-polyethyleneoxide, polyetheretherketone, polyethylene, polyethyleneimine, polyimide, polyisoprene, polylactide, polypropylene, polystyrene, polysulfone, polyurethane, polyvinylpyrrolidone, proteins, SEBS copolymer, silk, and styrene/isoprene copolymer.

Additionally, polymer blends can also be produced as long as the two or more polymers are soluble in a common solvent. A few examples would be: poly(vinylidene fluoride)-blend-poly(methyl methacrylate), polystyrene-blend-poly(vinylmethylether), poly(methyl methacrylate)-blend-poly(ethyleneoxide), poly(hydroxypropyl methacrylate)-blend poly (vinylpyrrolidone), poly(hydroxybutyrate)-blend-poly (ethylene oxide), protein blend-polyethyleneoxide, polylactide-blend-polyvinylpyrrolidone, polystyrene-blend-polyester, polyester-blend-poly(hyroxyethyl methacrylate), poly(ethylene oxide)-blend poly(methyl methacrylate), poly (hydroxystyrene)-blend-poly(ethylene oxide).

Examples of suitable hydrophilic polymers include, but are not limited to, linear poly(ethylenimine), cellulose acetate and other grafted cellulosics, poly (hydroxyethylmethacrylate), poly (ethyleneoxide), and polyvinylpyrrolidone. Examples of suitable polymers that are at least weakly hydrophobic include acrylics and polyester such as, poly(caprolactone), poly (L-lactic acid), poly (glycolic acid), similar copolymers of theses acids. As described in Smith et al, polymer solutions may optionally be applied in a sterile condition.

As suggested hereinabove, other additives, either soluble or insoluble, may also be included in the liquid(s) to be electrospun into the fibers. Preferably, these additives are medically important topical additives provided in at least therapeutic effective amounts for the treatment of the patient. Such amounts depend greatly on the type of additive and the physical characteristics of the wound as well as the patient. Generally, however, such additives can be incorporated in the fibers in amounts ranging from trace amounts (less than 0.1 parts by weight per 100 parts polymer) to 500 parts by weight per 100 parts polymer, or more. Examples of such therapeutic additives include, but are not limited to, antimicrobial additives such as silver-containing antimicrobial agents and antimicrobial polypeptides, analgesics such as lidocaine, soluble or insoluble antibiotics such as neomycin, thrombogenic compounds, nitric oxide releasing compounds such as sydnonimines and NO-complexes that promote wound healing, other antibiotic compounds, bacteriocidal compounds, fungicidal compounds, bacteriostatic compounds, analgesic compounds, other pharmaceutical compounds, adhesives, fragrances, odor absorbing compounds, and nucleic acids, including deoxyribonucleic acid, ribonucleic acid, and nucleotide analogs.

Figure 5A:
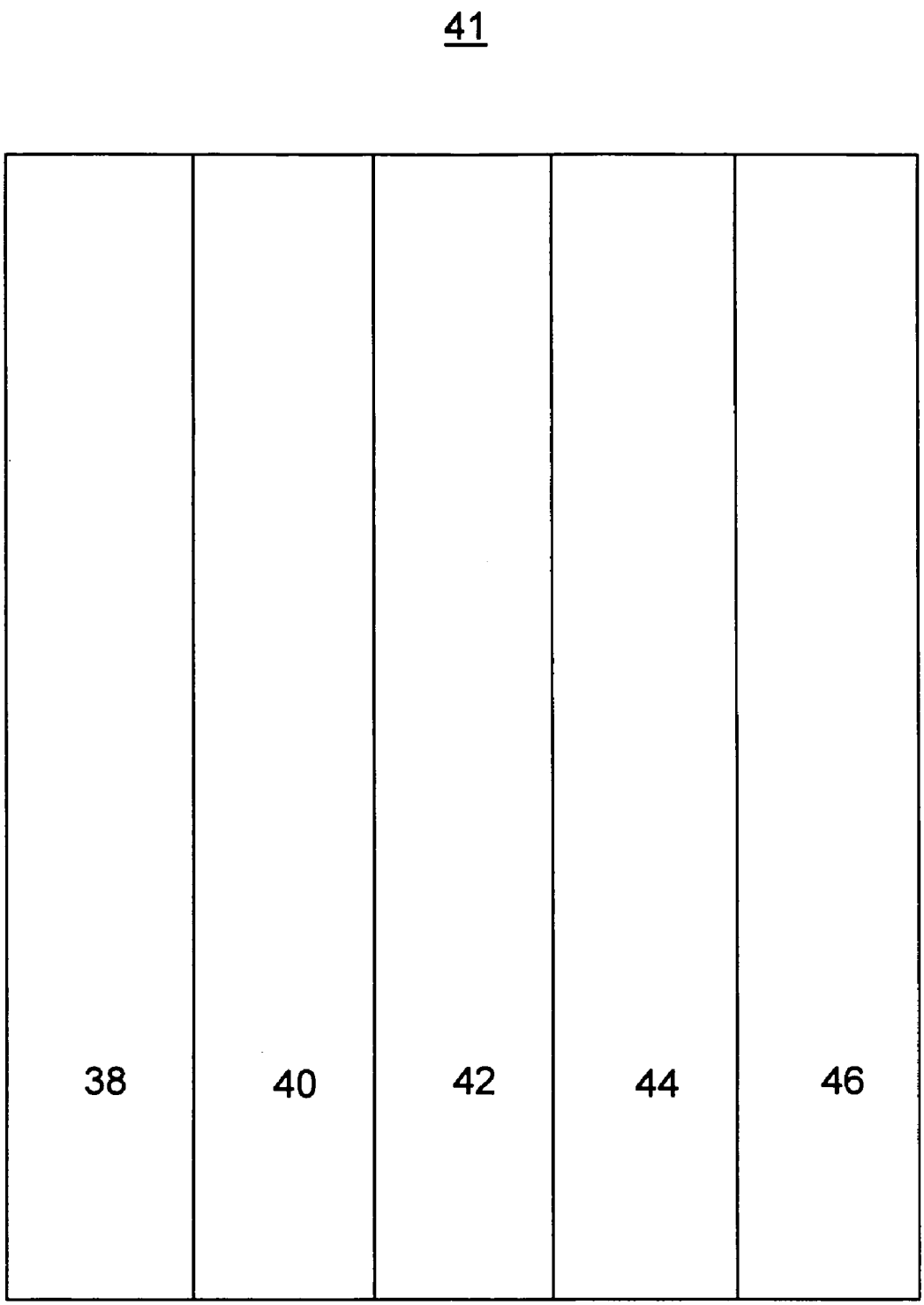
FIG. 5A is a schematic illustration of a mat of multicomponent fibers according to one embodiment of the present invention.

Once the various fibers intermingle with each other, a seed of the fiber mat is formed. The core of the fiber mat 41 is shown in core region 42 in FIG. 5A. Region 42 of the fiber mat 41 includes various fibers electrospun by a corresponding electrospinning device. However, after the core region 42 is formed, due to the opposite arrangement of the electrospinning devices and the disposition of the collection electrode there between, fibers from each respective electrospinning device penetrate less into the core region 42 and the newly electrospun fibers start to accumulate on each side of the core region 42, in regions 40 and 44 respectively. Thus, each region 40 and 44 includes mainly the fibers produced from the substance held by the electrospinning device closest to that side of the core region 42. If the electrospinning devices are continuing to electrospin fibers, few newly electrospun fibers can penetrate the regions 40, 42, and 44, and new regions 38 and 46 form on the regions 40 and 44, respectively. The newly formed regions 38 and 46 include almost exclusively the fibers electrospun from each of the respective electrospinning devices.

Figure 5B:
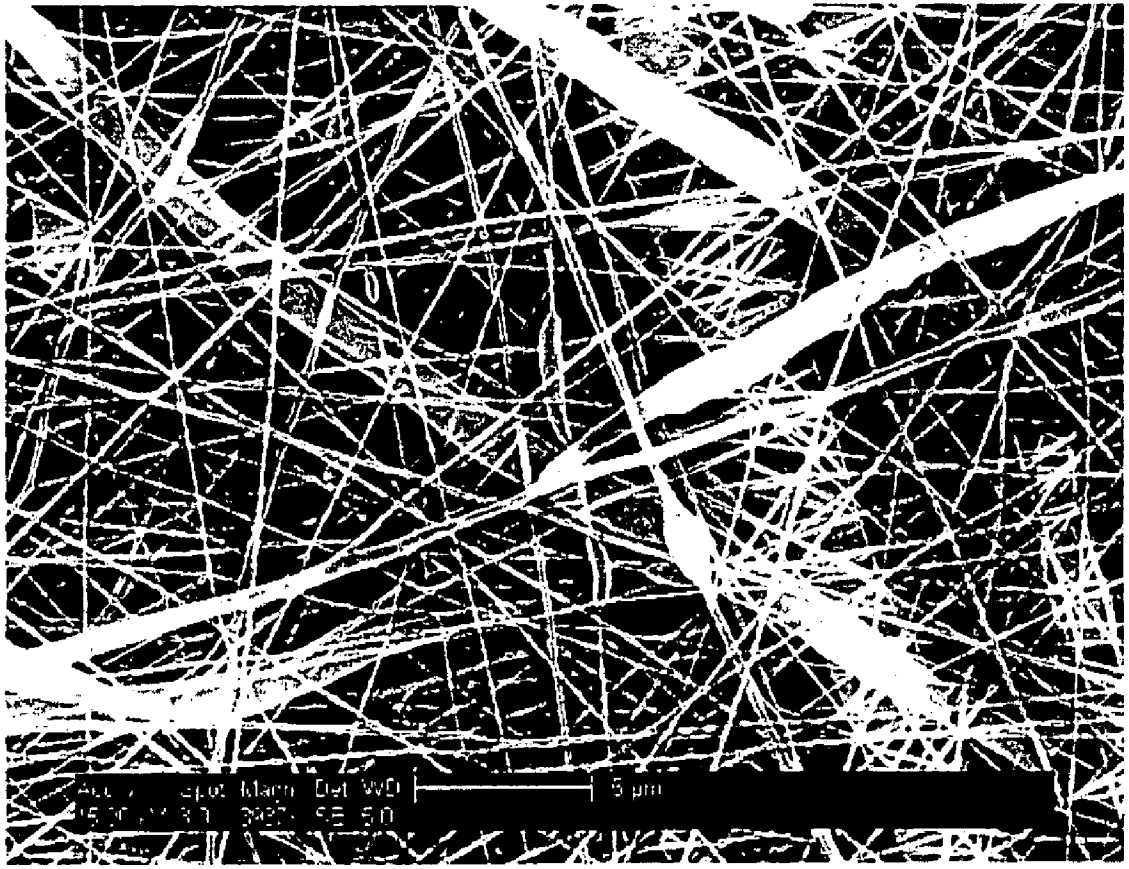
FIG. 5B is a SEM micrograph of the fibers in a mat region produced according to the present invention.

FIG. 5B shows a SEM micrograph of the fibers formed in the core region 42 of the mat. The thick fibers in FIG. 5B have been obtained by using 22.5% of polystyrene in dimethylformamide and the thin fibers have been obtained by using 20% of polycaprolactone in dimethylformamide/methylene chloride (20/80). The SEM micrograph shown in FIG. 5B represents a plan view of fibers in the mat.

Figure 5E:
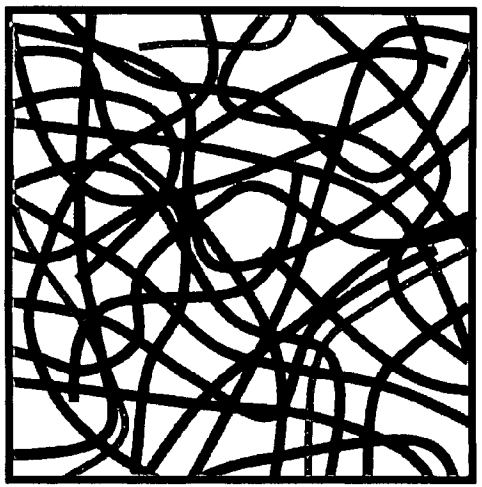
FIGS. 5C-5E are schematic illustrations of fiber distributions in regions corresponding to a first end, a central portion, and a second end of a fiber mat of the present invention.
Figure 5D:
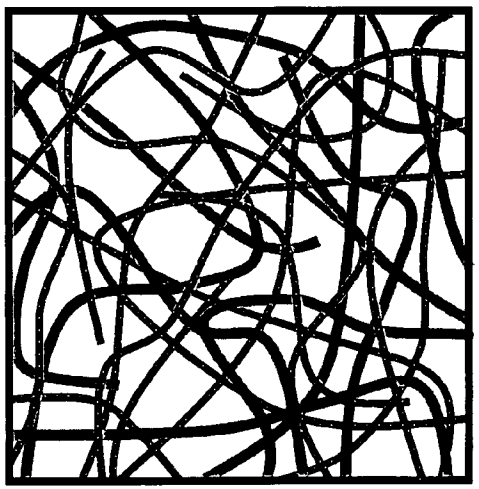
Figure 5C:
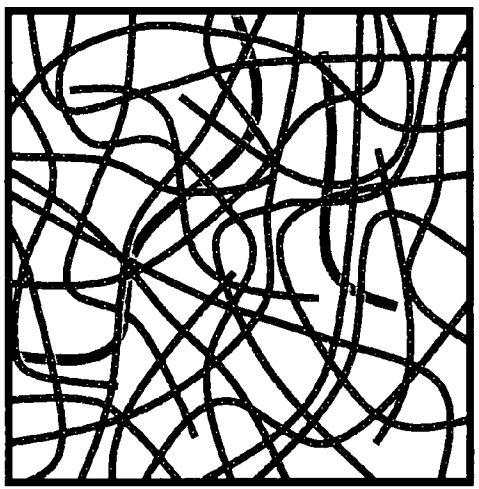

FIGS. 5C-5E schematically illustrate a change in the distribution of the fibers in the plan view of the mat when the plan view of the mat is (i) close to one side of the mat (see FIG. 5C), (ii) substantially at equal distances from the sides of the mat (see FIG. 5D), and (iii) close to the other side of the mat (see FIG. 5E). The sides of the mat are those exposed surfaces of the mat after formation, defined by the last fibers formed during the electrospinning process performed by the device shown in FIG. 2. FIG. 5C shows that the concentration of first fibers is higher than the concentration of the second fibers and FIG. 5E showing a reverse of those concentrations. The first and second fibers are illustrated in FIGS. 5C-5E as having different thicknesses. However, the thickness of the fibers in the figures is intended to distinguish the two fibers and not to limit the fibers of the mat to fibers having different thicknesses. In other words, the two fibers shown in FIGS. 5C-5E could be fibers having the same thickness and different chemical compositions.

Referring back to FIG. 5A, in the regions 38, 40, 44, and 46, the fibers electrospun from the opposed electrospinning devices do not intermingle as strong as in the region 42, and these regions can be reduced or suppressed. For example, using the device shown in FIG. 2, a fiber mat can be produced to have only a region such as region 42 as the fibers coming from the respective electrospinning devices interact and intermingle with each other without having to penetrate the fiber mat.

In another embodiment of the present invention, a metal frame, used to collect the nanofibers, can be rotated either continuously or intermittently by design, to obtain highly-interpenetrated or interwoven fiber mats and/or to produce mats with a uniform distribution of the first and second fibers. In other words, the changing in fiber concentration in a plan view of the mat described above could be reduced if the metal frame rotates such to expose parts of the metal frame preferentially to the first electrospinning device and then to the second electrospinning device. Thus, the layers of the mat do not merely lie on top of one another, but in one embodiment of the present invention interpenetrate at the layer boundaries.

For example, in this embodiment, the collector 20 shown in FIG. 2 can be rotated, thus functioning as a rotational collector. More specifically, the collector 20 can be rotated around the shown vertical axis to expose gradually one side of the collector 20 to fibers from the electrospinning device 11*a* and then to expose the same side to fibers from the electrospinning device 11*b*.

Alternatively, the collector 20 in FIG. 4 could be rotated about the shown vertical axis to expose sequentially one quadrant of the upper collector to fibers from the electrospinning device 22*a* and then to expose the same quadrant to fibers from the electrospinning device 22*b*.

As disclosed in U.S. application Ser. No. 10/819,945, control of the gaseous environment about the extrusion element 18 improves the quality of the fiber electrospun with regard to the distribution of nanofiber diameter and with regard to producing smaller diameter nanofibers. For example, by modifying the electrical properties of the gaseous environment about the extrusion element 18, the voltage applied to the extrusion element can be increased and a pulling of the liquid jet from the extrusion element 18 can be improved. In particular, injection of gases in an enclosure around the electrospinning devices appears to reduce the onset of a corona discharge (which would disrupt the electrospinning process) around the extrusion element tip, thus permitting operation at higher voltages enhancing the electrostatic force. Further, injection of electronegative gases reduces the probability of bleeding-off charge in a Rayleigh instability region of the fiber, thereby enhancing the stretching and drawing of the fiber under the processing conditions. However, controlling the gaseous environment about the extrusion elements 18 is performed to enhance the electrostatic force and the drawing of the fibers.

As shown in FIG. 2, by maintaining a liquid pool 30 at the bottom of the chamber 28, the amount of solvent vapor present in the ambient about the electrospinning environment can be controlled by altering a temperature of the chamber 28 and/or the solvent pool 30, thus controlling the partial pressure of solvent in the gaseous ambient in the electrospinning environment. Optionally, a flow controller 34 can be used to control a flow rate of gaseous species to the fiber extraction fiber from a gas supply 32.

Further, an atmosphere in the enclosure is controlled such that at least one of an evaporation rate of a solvent from the first and second electrospun substances and an electrical resistance of the atmosphere is varied. The liquid of the liquid pool 30 includes, for example, at least one of dimethylformamide, formamide, dimethylacetamide, methylene chloride, chlorobenzene, chloroform, carbon tetrachloride, chlorobenzene, chloroacetonitrile, carbon disulfide, dimethylsulfoxide, toluene, benzene, styrene, acetonitrile, tetrahydrofuran, acetone, methylethylketone, dioxanone, cyclohexanone, cyclohexane, dioxane, 1-nitropropane, tributylphosphate, ethyl acetate, phosphorus trichloride, methanol, ethanol, propanol, butanol, glycol, phenol, diethylene glycol, polyethylene glycol, 1,4-butanediol, water, other acid, other alcohol, other ester alcohol, other ketone, other ester, other aromatic, other amide, and other chlorinated hydrocarbon, and the flow controller 34 controls a supply of, for example, at least one of electronegative gases, ions, and energetic particles. A gas supply includes a supply of at least one of $CO_2$, CO, $SF_6$, $CF_4$, $N_2O$, $CCl_4$, $CCl_3F$, and $CCl_2F_2$.

Figure 6A:
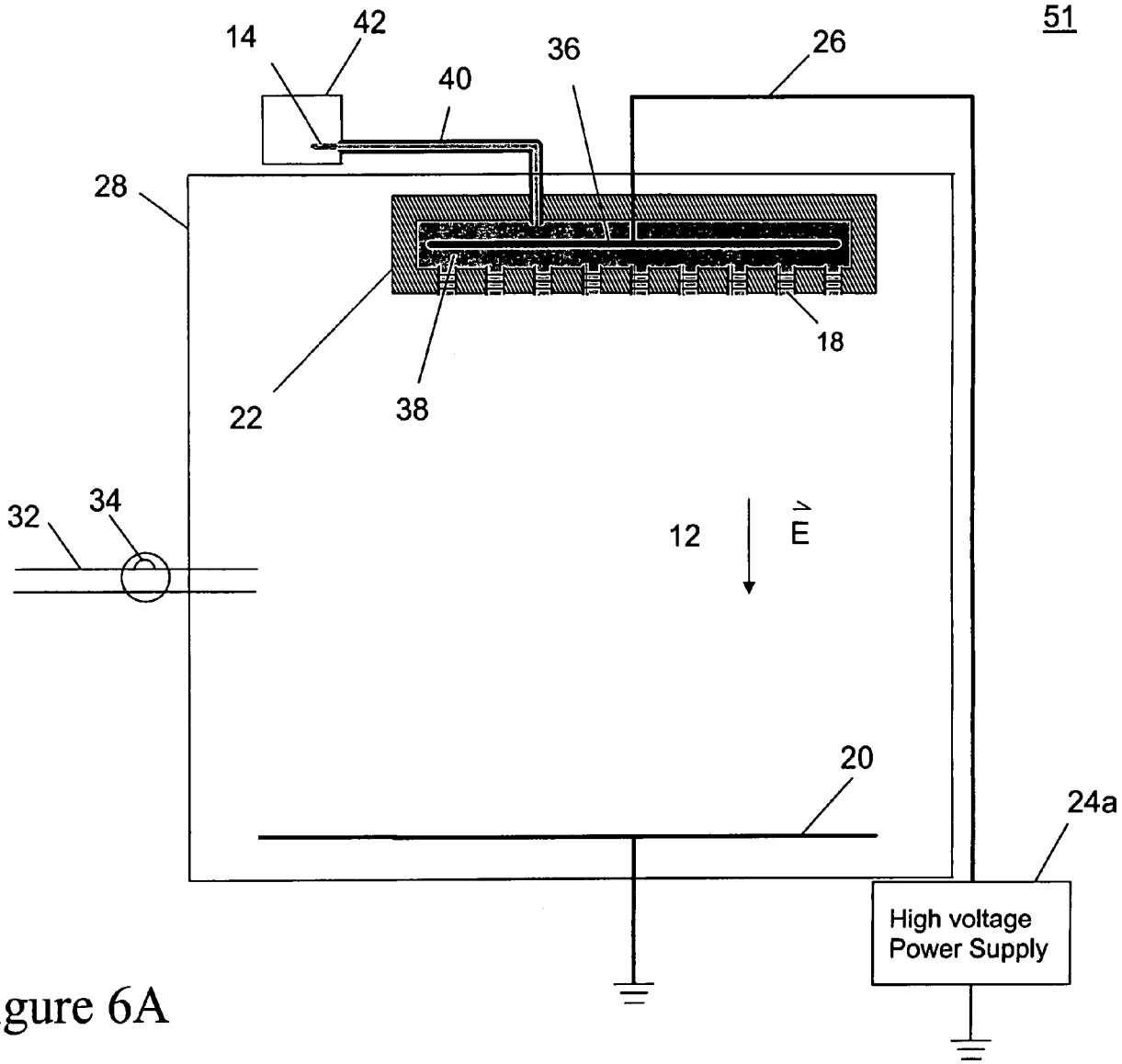
FIG. 6A is a schematic illustration of an electrospinning apparatus having a plurality of extrusion elements used in another embodiment of the present invention.

FIG. 6A shows in more detail an electrode spin device 51 of an electrospinning device, similar to the spin head disclosed in U.S. application Ser. No. 10/819,942. The electrospinning device 51 shown in FIG. 6A produces an electric field 12 that extrudes the electrospin medium 14. The electric field 12 is directed by an electrode 36 through one or a plurality of extrusion elements 18 formed in a wall of the enclosure 22, in which the solution 14 is enclosed. Details of the enclosure 22 and the extrusion elements 18 are given in U.S. Ser. No. 10/819,425, previously incorporated by reference. The enclosure 22 is made of an insulating material or an electrical permeable material. The extrusion elements 18 are provided in the wall of the enclosure 22 opposite to the electrode 36, to define between the extrusion elements 18 and the electrode 36 a space 38. The enclosure 22 communicates through a passage 40 with a source 42 of the electrospin medium 14. Various possible arrangements of the electrodes 20 and 36, distances between these electrodes, various constructions of the extrusion elements and their materials, the dimensions of the extrusion elements, and the voltage applied to the extrusion elements are disclosed in U.S. patent application Ser. No. 10/819,942. In one embodiment of the present invention, electrospinning devices 11*a* and 11*b* are configured as electrospinning device 51.

As illustrative of the process of the present invention, the following non-limiting examples are given to illustrate selection of the polymer and solvent for the fibers, the tip diameter of the extrusion elements, the collector material, the solvent pump rate, the electric field, and the polarity of the fibers:

EXAMPLE I a poly(ethylenimine) solution of a molecular weight of 1050 kg/mol for the first fibers and a poly(caprolactone) solution of a molecular weight of 100 kg/mol for the second fibers, a solvent of dimethylformamide (DMF) for both the first and second fibers, extrusion elements tip diameter of 1000 μm for both fibers, an Al ring collector, 0.5 to 1.0 ml/hr pump rate providing the polymer solution to the extrusion elements, a gas flow rate in the range of 0.5 to 50 lpm, an electric field strength of 2 kV/cm for electrospinning the first and second fibers, positive polarity for the first fibers and negative polarity for the second fibers, and a gap distance between the tip of the extrusion elements and the collector of 17.5 cm.

Using the above substances for electrospinning and the above conditions, a mat having the first fibers made of a material different than the second fibers is obtained. The resultant fiber diameter depends on several variables and for a given set of variables, will vary from polymer to polymer. This example further represents a mat of hydrophilic and hydrophobic fibers.

EXAMPLE II a polystyrene solution of a molecular weight of 1050 kg/mol for the first fibers and a polystyrene solution of a molecular weight of 2000 kg/mol for the second fibers, a solvent of dimethylformamide DMF for both the first and second fibers, extrusion elements tip diameter of 1000 μm for both fibers, an Al ring collector, 0.5 to 1.0 ml/hr pump rate providing the polymer solution to the extrusion elements, a gas flow rate in the range of 0.5 to 50 lpm an electric field strength of 2 kV/cm for the first fibers, an electric field strength of 5 kV/cm for the second fibers, positive polarity for the first fibers and negative polarity for the second fibers, and a gap distance between the tip of the extrusion elements and the collector of 17.5 cm.

The resultant fiber mat includes first fibers with a first average diameter and second fibers with a second average diameter, different than the first average diameter. In this illustration, the molecular weight characteristics of the electrospin medium and the electric field influence the resultant fiber diameter size, with the electric field applied to the extrusion elements extruding the first fibers at 2 kV/cm and the electric field applied to the extrusion elements extruding the second fibers at 5 kV/cm.

Figure 6B:
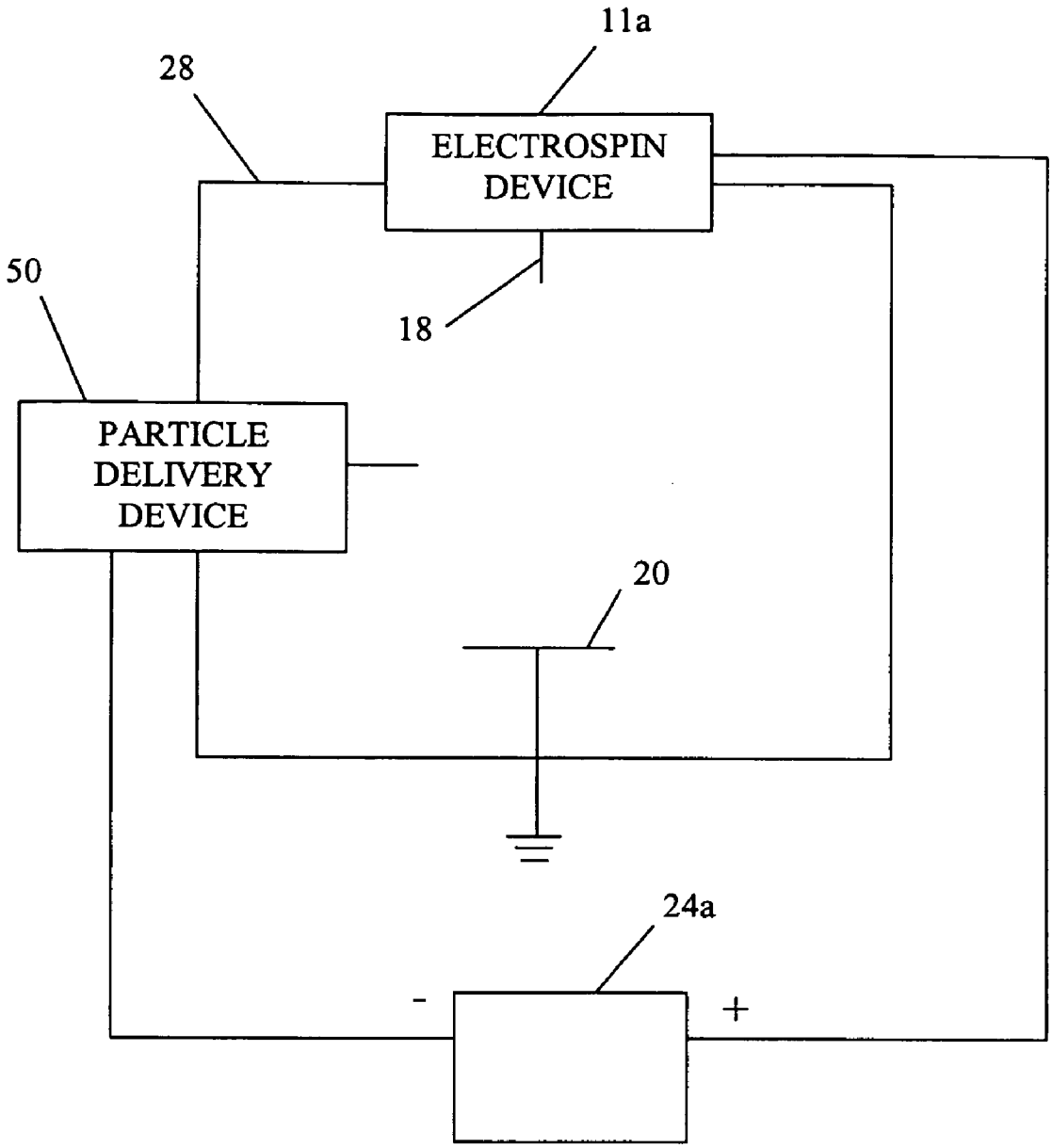
FIG. 6B is a schematic illustration of an electrospinning apparatus having a particle delivery device according to another embodiment of the present invention.
Figure 7A:
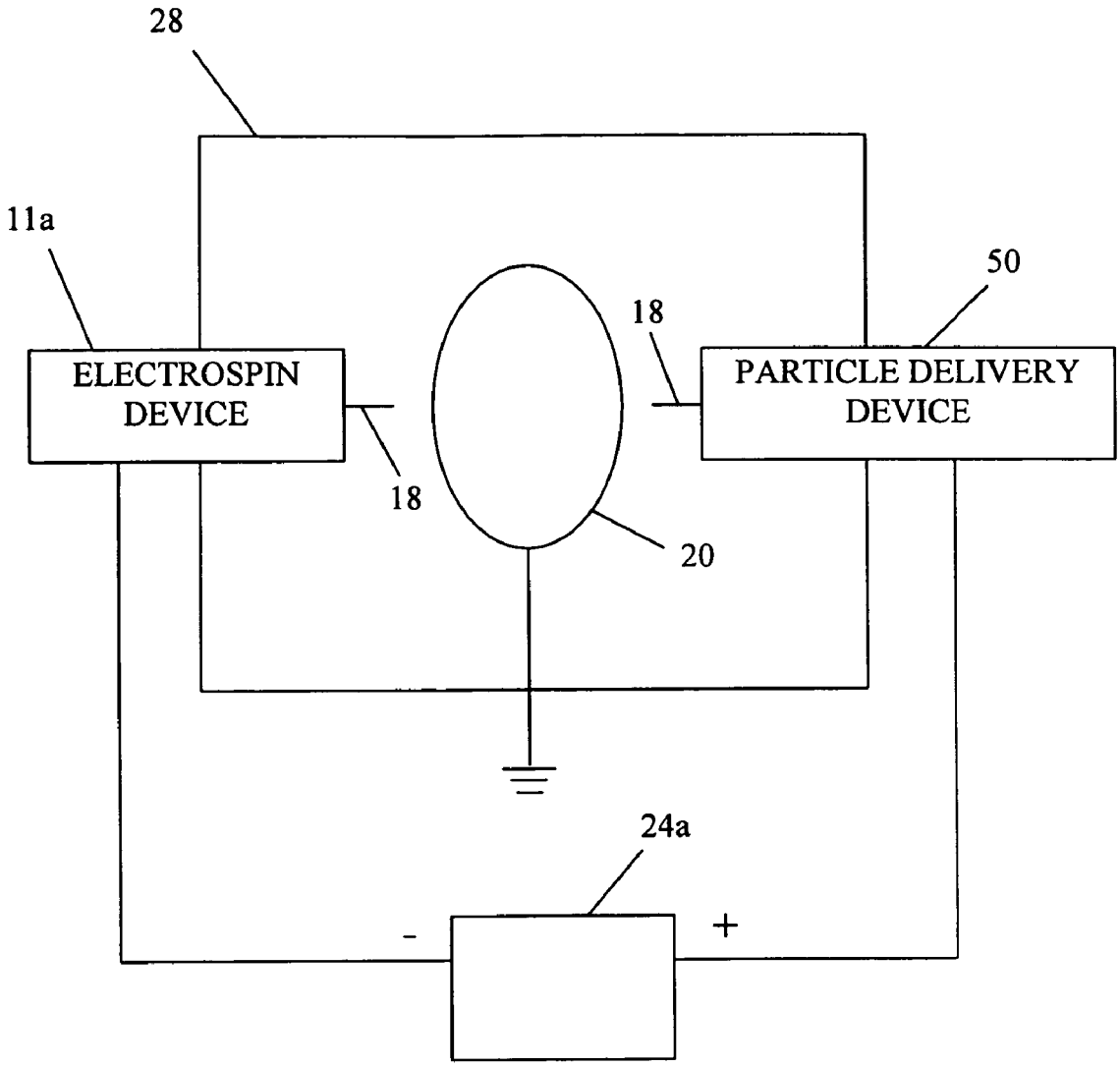
FIG. 7A is a schematic illustration of an electrospinning apparatus having an opposed particle delivery device according to another embodiment of the present invention.

Additionally, in one embodiment, particles can be injected into a fiber extraction region of the electrospinning devices to produce fibers with partially embedded particles. The particles can be injected under similar conditions to those described above for the fiber electrospinning conditions. For instance, FIGS. 2, 6B, and 7A show a particle delivery device 50 that delivers particles to a fiber forming region such that the delivered particles collide and combine with at least one of the first and second electrospun substances to form fibers having attached particles. For instance, FIG. 2 shows a particle delivery device 50 that delivers particles to a fiber forming region such that the delivered particles collide and combine with at least one of the first and second electrospun substances to form fibers including the particles. The particle delivery device 50 can include a particle guide device 52 that guides the particles into a part of fiber forming region. The particle delivery device 50 can include at least one of a nebulizer and an atomizer. The particle delivery device 50 may have a collimator 56 configured to collimate the particles. The particle delivery device 50 can also have a particle source 58, a gaseous carrier source 60 in communication with particles output by the particle source 58, and a flow regulator 62 configured to regulate a gas flow from the gaseous carrier source. The speed of the particles admitted into the chamber 28 thus depends on the gas flow from the regulator 62. In one embodiment not shown in FIG. 2, the particle delivery device 50 can be replaced entirely by an electrospray device similar to the electrospinning devices 11*a* and 11*b*. The electrospray device replacing the particle delivery device 50 can supply the materials discussed above for the particle delivery device 50. As such, a gaseous medium can be used (see FIG. 6A, flow controller 34 and gas supply 32) in a vicinity of the electrospray device to affect the electrosprayed particles. The particle delivery device 50 can operate in parallel to or in the absence of the electrospray device.

The particle delivery device 50 can supply at least one of a metallic material, an organic compound, an oxide material, a semiconductor material, an electroluminescent material, a phosphorescent material, a medical compound, and a biological material.

The particle delivery device 50 in one embodiment of the present invention can be a Collision nebulizer that provides suspended nanosized particles into a first carrier (e.g., a carrier gas) to form an aerosol. The Collision nebulizer can be connected to a diffusion dryer to evaporate traces of water (or other vapors) from the aerosol before injecting the aerosol of particles into a region about where the substance to be extruded is electrospun, i.e., where the fibers are produced. Commercially available Collision nebulizers such as for example available from BGI, Waltham, Mass., are suitable for the present invention. The nebulizer of the present invention can provide electrically charged airborne particles to a region of where the substance 14 to be extruded is electrospun. For example, nanosized silicon particles suspended in carbon tetrachloride and then nebulized in the Collision nebulizer can provide an aerosol of silicon particles for injection into a region where the substance 14 to be extruded is electrospun. Suspension of the particles in a carrier fluid can be obtained not only by nebulization but also by atomization, condensation, dried dispersion, electrospray, or other techniques known in the art.

The present inventors have discovered that charging the particles provided by the particle delivery device 50 with an electric charge opposite to the electric charge with which the electrospin medium 14 is charged, not only promotes the attraction of the particles to the fibers but also tends to prevent the particles from coalescing with each other during deposition on the fibers. In other words, because the particles have the same electric charge, the particles tend to repel each other, and stay separate from each other on the fibers. In addition, by having the particles charged with a charge opposite to the charge of the fibers, more particles can interact with the fibers due to the electric attraction between the particles and the fibers. Therefore, the process of charging the particles oppositely to the charge of the fibers can achieve a high rate of collision between the particles and the fibers.

The inventors of the present invention have discovered that, if the particles provided collide with the electrospun material before the electrospun material is completely dried, the particles can attach to the fibers. However, some particles may interact with the electrospun material after the material has dried but can nevertheless be entrapped in the fiber mats of the present invention.

The particles included into the fiber mats of the present invention can be composed of a variety of materials including but not limited to pharmaceuticals, polymers, biological matter, ceramics, and metals. Even particles that do not mix with the polymer solution can be included in the fiber mats of the present invention. The particles delivered in the present invention have a diameter ranging preferably from 5 nanometers to 100 nanometers, and can have diameters as large as a few microns (e.g., 1-5 μm).

In one embodiment of the present invention, the particles can be provided from an electrospray device. By electrospraying, an electrospray material is charged to a high electric potential and then expelled by the high electric field at the tip of the electrospray device. Due to the high electric charges on the particles of the material, the expelled electrosprayed particles form a mist of electrically charged particles.

The electrospray device constituting the particle delivery device 50, in this embodiment, is placed to a side of the extrusion element 18 of the electrospinning device 11*a* to provide particles directed toward a horizontal path as shown in FIG. 6B, although other directions may also be used. The electrospinning device 11*a* is configured to provide the fibers directed toward a vertical path, although other directions may also be used, such that the path of the fibers intersects the path of the particles, as shown in FIG. 6B. Optionally, a chamber 28 could be placed around the extrusion element 18.

In another embodiment, the particle delivery device 50 and the electrospinning device 11*a* can be disposed in a horizontal arrangement as shown in FIG. 7A. Thus, both the fibers and the particles are expelled horizontally into the chamber 28, with the fibers and the particles being collected by the collection electrode 20, which can be placed vertically, as shown, or horizontally if the particle delivery device 50 and the electrospinning device 11*a* are directed to the horizontal direction.

Figure 7B:
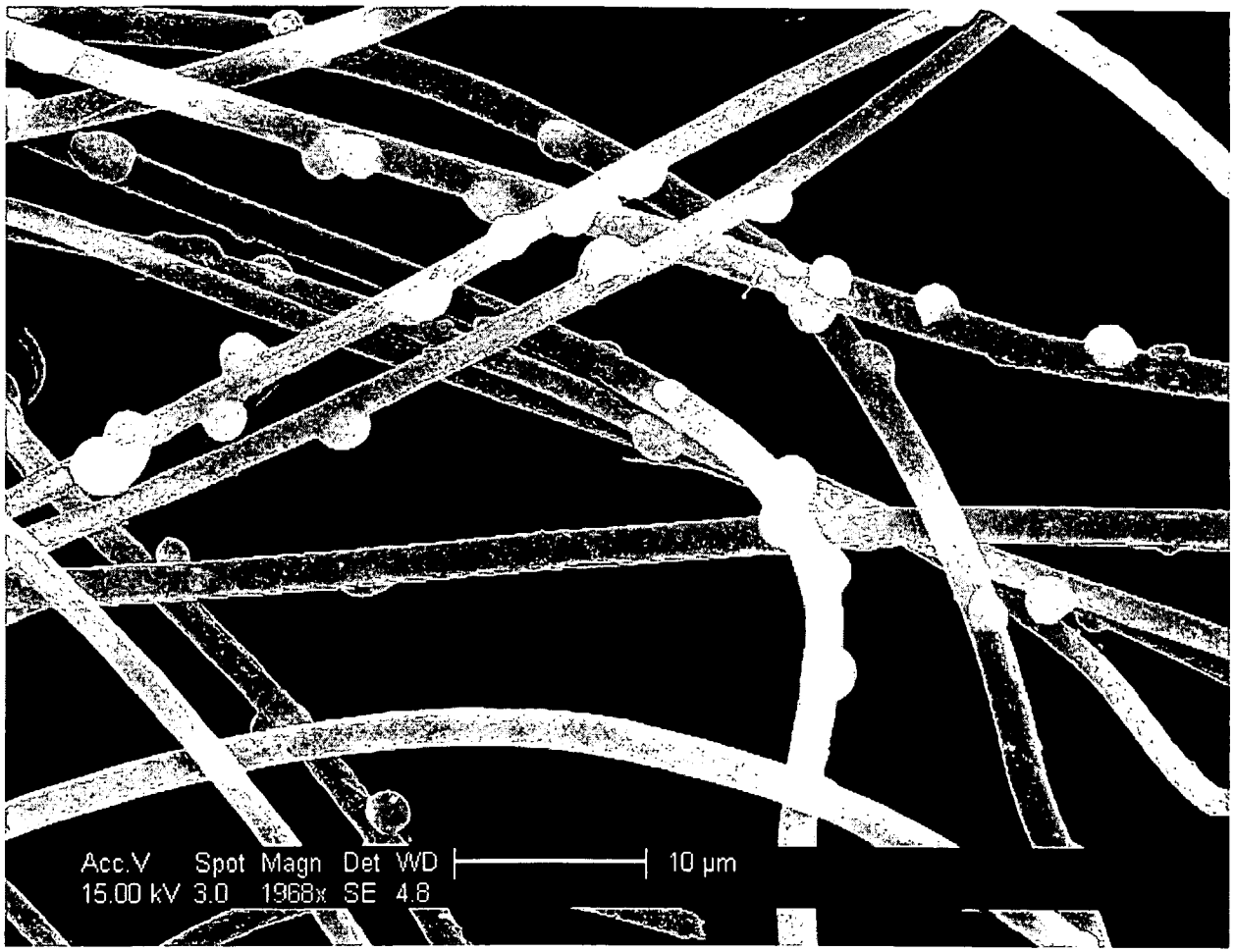
FIG. 7B is a SEM micrograph of a particle/fibers of the present invention.

FIG. 7B is a micrograph of a particle/fiber composite made by the present invention. In preparing the particle/fiber composite shown in FIG. 7B, an electrospray nozzle and an electrospinning head, maintained at (~20 kV but at different polarities) were set up facing each other separated by a distance of 15-30 cm in a cross-shaped glass chamber. In other experiments, the electrospinning was done in a vertical direction (as described above) and the electrospray was carried at right angles to the vertical direction, at a distance of 9-15 cm from the tip of the electrospinning needle.

The distance between the spinhead needle and the sprayhead needle was controlled. If the distance is too close the fibers tend to be attracted and deposited on the sprayhead. If the distance is too far apart the sprayed particles will not adequately be attached to the nanofibers. The ranges given above have been found to be appropriate, but the present invention is not so limited and other distances are suitable for the present invention.

The particles in FIG. 7B are PCL (polycaprolactone) produced by electrospraying a 1% (w/w) solution of the polymer in methylene chloride in an atmosphere of carbon dioxide. The solution of the polymer was pumped into a stainless steel hypodermic syringe needle (guage 25) at a flow rate of 0.5 ml per hour. The needle was connected to the negative terminal of a 20 kV power supply.

The fibers in FIG. 7B are polystyrene electrospun from a 25% (w/w) solution in DMF using a similar 25 gauge stainless steel needle. The flow rate of the polymer into the needle was controlled at 0.5 ml per hour. The needle was connected to a positive terminal of a 20 kV power supply.

A ground plate was used at the bottom of the chamber and served to collect the nanofiber with attached particles product formed.

Other electrospinning devices could be used along with electrospinning device 11*a* in FIGS. 6B and 7A such as for example the electrospinning devices 11*a* and 11*b* in FIG. 2 to produce multicomponent fiber mats (as described above) that include attached particles.

Figure 8:
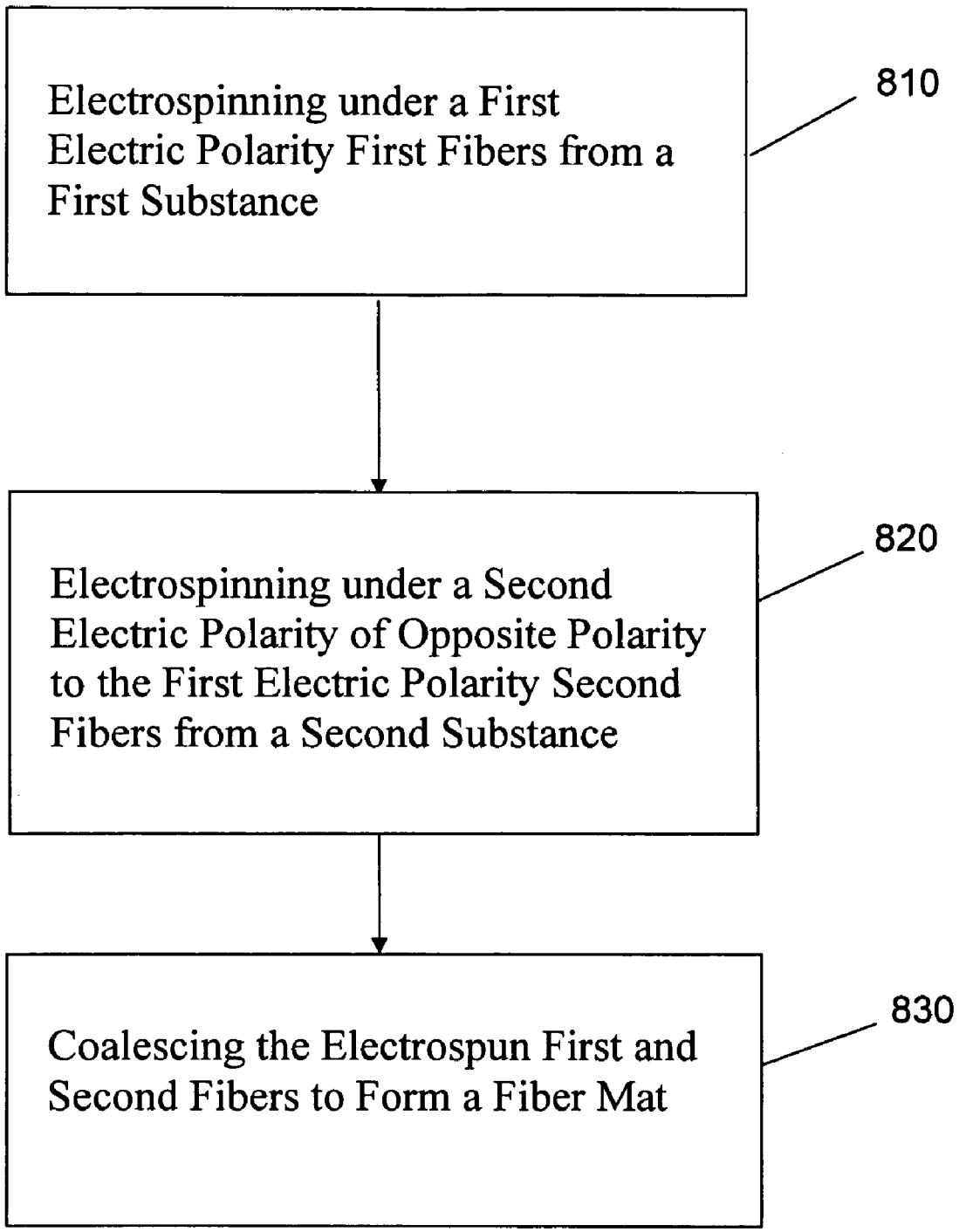
FIG. 8 is a flowchart depicting a method of the present invention.

FIG. 8 is a flowchart depicting one method of the present invention. In step 810, first fibers are electrospun under a first electric polarity from a first substance. In step 820, second fibers are electrospun under a second electric polarity of opposite polarity to the first electric polarity from a second substance. In step 830, the electrospun first and second fibers are coalesced to form a fiber mat. However, FIG. 8 does not imply that steps 810 and 820 are only sequential. In fact, the steps 810 and 820 according to the present invention can be performed simultaneously or sequential function of the desired characteristics of the mat to be formed.

The method optionally includes providing the first and second substances with different chemical compositions. The method can as well provide first and second substances of the same chemical composition or material. The method can combine fibers of the same average diameter or different average diameters. Hence, the method can produce in the fiber mat first and second fibers of the same or different chemical composition or material. Additionally, the method can produce a fiber mat having fibers of the same or different average diameters included therein.

Furthermore, by electrospinning for example identical or different fibers from the two electrospinning devices 11*a* and 11*b*, a particle/fiber mat composite having a cross sectional density (as before) of $(2.5\times10^{13})/d^2$ fibers/cm$^2$ can be achieved that includes attached particles.

In step 830, coalescing optionally includes electrostatically attracting the fibers of the first and second electrospun substances due to opposite electric charges on the first and second electrospun fibers, and combining the first and second electrospun fibers in a region where the first and second electrospun fibers include a solvent content. Coalescing the first and second fibers includes combining the first and second fibers in a region where the solvent content of the first and second electrospun fibers is low enough to prevent fibers adhering to each other or combining the first and second fibers in a region where the solvent content of the first and second electrospun fibers is high enough to obtain adhesion and to produce partial blending of the first and second fibers, the solution content being variable for each polymer-solvent combination, and preferably between 20 and 80 weight %.

The method optionally controls an atmosphere in a vicinity of the electrospun first and second fibers so as to adjust at least one of an evaporation rate of a solvent from the first and second fibers and an electrical resistance of the atmosphere. The controlling of the atmosphere can be achieved by providing a vapor pressure of a liquid to the atmosphere and/or controlling a temperature of a vapor pool container containing the liquid. The vapor includes, for example, at least one of dimethylformamide, formamide, dimethylacetamide, methylene chloride, chlorobenzene, chloroform, carbon tetrachloride, chlorobenzene, chloroacetonitrile, carbon disulfide, dimethylsulfoxide, toluene, benzene, styrene, acetonitrile, tetrahydrofuran, acetone, methylethylketone, dioxanone, cyclohexanone, cyclohexane, dioxane, 1-nitropropane, tributylphosphate, ethyl acetate, phosphorus trichloride, methanol, ethanol, propanol, butanol, glycol, phenol, diethylene glycol, polyethylene glycol, 1,4butanediol, water, other acid, other alcohol, other ester alcohol, other ketone, other ester, other aromatic, other amide, and other chlorinated hydrocarbon. The controlling of the atmosphere can include providing a gas supply of at least one of electronegative gases, non-electronegative gases, ions, and energetic particles and the supply can include supplying at least one of $CO_2$, CO, $SF_6$, $CF_4$, $N_2O$, $CCl_4$, $CCl_3F$, and $CCl_2F_2$.

The method can include collecting the first and second fibers on a collection electrode and the collection electrode optionally includes at least one of a loop, a net, a hook, and a web. The collection electrode can be a grounded electrode.

The electrospinning under a first electric polarity and the electrospinning under a second electric polarity can include extracting the first and second fibers in opposing directions towards each other and the method can include storing at least one of the first and second substances in a compartment having extrusion elements mounted in a wall of the compartment. If the compartment is present, then the method can include radiating an electric field from the compartment by an electrode disposed inside the compartment.

The method can provide the first and second substances in a solvent and also can provide at least one of the first and second substances with a polymeric substance included in the solvent. The providing at least one of the first and second substances with a polymeric substance can include providing in the first and second substances different polymeric substances dissolved by the solvent.

By controlling one or more of an electric field, a solvent composition, a polymer type, flow rate, and a gas environment, the present embodiment can create fibers of different diameters. Such information on setting such parameters is known in the art of electrospinning, see for example U.S. Pat. No. 6,110,590 and the patent references disclosed in that patent, the entire contents of which are incorporated by reference herein. Electrospinning of the present invention can electrospin for example from the two electrospinning devices shown in FIG. 2 fibers of different average diameters provided all other variables including for example the polymer type and the solvent are the same if different applied electric fields are used. For example, by applying an electric field strength of 10,000 to 100,000 V/m in a vicinity of one of the electrospinning devices, nanofibers can be produced having an average diameter less than 1 μm. And for example, by applying an electric field strength of 50,000 to 200,000 V/m in a vicinity of one of the electrospinning devices, nanofibers can be produced having an average diameter less than 500 nm. By applying an electric field strength of 150,000 to 400,000 V/m in a vicinity of one of the electrospinning devices, nanofibers can be produced having an average diameter less than 100 nm.

The method, during electrospinning, can deliver particles in a vicinity of the electrospun first and second fibers such that the particles combine with at least one of the electrospun first and second fibers. Combining the particles with the electrospun fibers would preferably occur for electrospun fibers having a solvent content, as described above.

The particles can be delivered by at least one of a nebulizer, an atomizer, and an electrospray device. A collimator can be used to collimate the particles. Particles from a particle source can be mixed and transported with a gaseous carrier, such as for example entraining the particles in a regulated flow of the gaseous carrier. As understood in the art, the speed of the particles depends on the gas flow rate. As illustrated here, the particles can be delivered by an electrospray device.

The particles can be at least one of a metallic material, an organic material, an oxide material, a semiconductor material, an electroluminescent material, a phosphorescent material, a medical compound, and a biological material. The particles can be nanoparticles having an average diameter less than 500 nm.

The coalescing can combine the first and second fibers to produce a region in the fiber mat in which adjacent fibers have a separation less than an average diameter d of one fiber of the first and second fibers, the average diameter being determined along a length of the one fiber. As such, a region in the fiber mat can have a cross section fiber density of at least $(2.5\times10^{13})/d^2$ fibers/cm$^2$, where d is an average diameter of one fiber of the first and second fibers and a value of d is given in nm.

Applications

As noted a fiber mat can be formed by the present invention in which one set of fibers has a first average diameter and a second set of fibers has a second average diameter such that the first set serves as a mechanical support for the second set. In one embodiment, the second set of fibers includes nanofibers having a diameter not limited to but preferable less than 500 nm.

Another application of the fiber mat of the present invention is for a medical product that substitutes the functions of the human or animal skin in medical cases (e.g., burns) in which the skin has been destroyed. It is know that a large percentage of the people suffering burns die because the functions performed by the skin cannot be substituted by any device. The main functions of the skin are (i) to prevent foreign objects to penetrate from outside the organism into the organism, (ii) to remove exudates away from a wound surface, and (iii) to allow certain fluids (water) to leave the organism. A plurality of fibers having a same chemical composition cannot achieve these two opposing functions. However, a mat of fibers composed of fibers with different chemical compositions can perform the functions of the skin when one of the fibers has function (i) and the other fiber has function (iii). Thus, the two fibers that simulate the human skin could be for example hydrophobic and hydrophilic fibers. The hydrophobic fibers include at least one of poly (alkyl acrylate), polybutadiene, polyethylene, polylactones, polystyrene, polyacrylonitrile, polyethylene terephthalate), polysulfone, polycarbonate, and poly(vinyl chloride), and the hydrophilic fibers include at least one of poly(acrylic acid), poly(ethylene glycol), poly(vinyl alcohol), poly (vinyl acetate), cellulose, poly(acrylamide), proteins, poly (vinyl pyrrolidone), and poly(styrene sulfonate).

The present inventors have found that the integrity of a mat having two fiber types displaying different functions is better when these fibers are formed as a mat where one surface of the mat includes mainly of the first type of fiber and the other surface of the second type of fiber with a gradient mix of the two fibers within the thickness of the fiber mat. The composition of the mat therefore changes from fiber type one to fiber type two across the thickness of the mat. The integrity of two separately spun layers of nanofiber mats made of the first fiber and of the second fiber sandwiched together, by comparison to the mat of the present invention, is considerably lower.

Another application of the mat of fibers is in the filtration field. Various filters commercially available include nanofibers to filter nanosized particles. However, the commercially available filters lack good adherence of the nanofibers to a substrate on which the nanofibers are formed. This problem causes the nanofibers to easily break away from the filter and to contaminate the medium. The fiber mat of the present invention solves that problem because the two different fibers have a high adherence and because one of the fibers could be formed with a high thickness to offer the required mechanical strength and the other fibers are nanofibers to offer the nanosized filtration function. Alternatively, the first fibers have a first elastic modulus and the second fibers have a second elastic modulus several times the elastic modulus of the first fibers, in a range of two to twenty, preferably in a range of two to five. Accordingly, the mat of fibers of the present invention has a good adherence and filtration function.

Numerous modifications and variations of the present invention are possible in light of the above teachings. It is therefore to be understood that within the scope of the appended claims, the invention may be practiced otherwise than as specifically described herein.

The invention claimed is:

1. A mat of fibers, comprising:

a plurality of intermixed first and second electrospun fibers comprising oppositely charged nanofibers; and a first region including said plurality of intermixed fibers, the first and second electrospun fibers having an average of diameters (d) less than 500 nm; and an average separation distance between the first and second fibers is equal to or proximate to d.

2. The mat of claim 1, wherein said first region has a cross section fiber density of at least $(2.5\times10^{13})/d^2$.

3. The mat of claim 1, wherein the first fibers comprise a material different than that of the second fibers.

4. The mat of claim 1, wherein the first fibers have a first elastic modulus and the second fibers have a second elastic modulus at least twice the first elastic modulus.

5. The mat of claim 4, wherein the first fibers comprise a material different than that of the second fibers.

6. The mat of claim 4, wherein the second elastic modulus is at least five times the first elastic modulus.

7. The mat of claim 6, wherein the first fibers comprise a material different than that of the second fibers.

8. The mat of claim 3, wherein the first fibers comprise hydrophobic fibers and the second fibers comprise hydrophilic fibers.

9. The mat of claim 8, wherein the hydrophobic fibers comprise at least one of poly(alkyl acrylate), polybutadiene, polyethylene, polylactones, polystyrene, polyacrylonitrile, polyethylene (terephthalate), polysulfone, polycarbonate, and poly(vinyl chloride).

10. The mat of claim 8, wherein the hydrophilic fibers comprise at least one of poly(acrylic acid), poly(ethylene glycol), poly(vinyl alcohol), poly (vinyl acetate), cellulose, poly(acrylamide), proteins, poly (vinyl pyrrolidone), and poly(styrene sulfonate).

11. The mat of claim 1, wherein the first fibers have a first average diameter along a length thereof and the second fibers have a second average diameter along a length thereof different from the first average diameter.

12. The mat of claim 11, wherein the first average diameter is less than 10 μm and the second average diameter is less than 500 nm.

13. The mat of claim 11, wherein the first average diameter is less than 1 μm and the second average diameter is less than 100 nm.

14. The mat of claim 1, wherein the first region comprises:

a region in which the first fibers vary in number relative to a number of the second fibers along a predetermined direction of the mat.

15. The mat of claim 14, wherein a relative number of the first fibers to the second fibers varies along the predetermined direction.

16. The mat of claim 15, wherein the first fibers comprise a material different than that of the second fibers.

17. The mat of claim 16, wherein a relative number of the first fibers to the second fibers varies linearly along the predetermined direction.

18. The mat of claim 15, wherein the first fibers have an average diameter along a length thereof different than that of the second fibers.

19. The mat of claim 18, wherein a relative number of the first fibers to the second fibers varies linearly along the predetermined direction.

20. The mat of claim 1, further comprising:

a second region disposed on a first side of the first region and having more first fibers than second fibers; and a third region disposed on a second side of the first region opposite the first side and having more second fibers than first fibers.

21. The mat of claim 20, wherein the first fibers of said second region comprise hydrophobic fibers; and the second fibers of said third region comprise hydrophilic fibers.

22. The mat of claim 20, wherein the first fibers of said second region have an average diameter less than 10 μm along lengths thereof; and the second fibers of said third region have an average diameter less than 500 nm along lengths thereof.

23. The mat of claim 20, wherein the first fibers of said second region have an average diameter less than 1 μm along corresponding lengths thereof; and the second fibers of said third region have an average diameter less than 100 nm along corresponding lengths thereof.

24. The mat of claim 1, wherein the first and second fibers comprise a same material.

25. The mat of claim 1, wherein the first and second fibers have the same average diameter.

26. The mat of claim 1, further comprising:

particles included with the mat.

27. The mat of claim 26, wherein the particles include at least one of a metallic material, an organic material, an oxide material, a semiconductor material, an electroluminescent material, a phosphorescent material, a medical compound, and a biological material.

28. A composite filter comprising:

a plurality of intermixed first and second electrospun fibers comprising oppositely charged nanofibers that form a composite of intermixed fibers;

the composite of intermixed fibers having an average of diameters (d) of less than 500 nm, and an average separation distance between the first and second fibers equal to or proximate to d.

29. A skin substitute comprising:

a membrane comprising plural electrospun hydrophilic fibers and plural electrospun hydrophobic fibers comprising oppositely charged nanofibers that form a composite of intermixed fibers;

the composite of intermixed fibers having an average of diameters (d) of less than 500 nm, and an average separation distance between the intermixed fibers equal to or proximate to d.

30. A filtration medium comprising:

a plurality of intermixed first and second electrospun nanofibers comprising oppositely charged nanofibers that form a composite of intermixed nanofibers;

the composite of intermixed nanofibers having an average of diameters (d) of less than 1 μm, and an average separation distance between the first and second nanofibers equal to or proximate to d.

31. The mat of claim 30, wherein the first nanofibers comprise a material different than that of the second nanofibers.

32. The mat of claim 30, wherein the first nanofibers have a first elastic modulus and the second nanofibers have a second elastic modulus at least twice the first elastic modulus.

33. A composite fiber mat comprising:

plural intermeshed electrospun fibers of a given polarity; and electrosprayed particles having a polarity opposite to the electrospun fibers and attached to at least one of the plural intermeshed fibers by a fiber material of the at least one of the plural intermeshed fibers;

wherein the electrosprayed particles are autogenously attached to the plural intermeshed fibers.

34. The mat of claim 33, wherein the particles are partially embedded in a surface of the plural intermeshed fibers.

35. The mat of claim 33, wherein the particles comprise at least one of a metallic material, an organic material, an oxide material, a semiconductor material, an electroluminescent material, a phosphorescent material, a medical compound, and a biological material.

36. The mat of claim 33, wherein the plural intermeshed fibers comprise a cross section fiber density of at least $(2.5\times 10^{13})/d^2$ fibers/cm$^2$, where a value of d is given in nm, is less than 500 nm, and comprises an average of diameters of the first and second fibers in a cross section of the composite fiber mat.

* * * * *

UNITED STATES PATENT AND TRADEMARK OFFICE

CERTIFICATE OF CORRECTION

PATENT NO. : 7,592,277 B2
APPLICATION NO. : 11/130269
DATED : September 22, 2009
INVENTOR(S) : Anthony L Andrady et al.

It is certified that error appears in the above-identified patent and that said Letters Patent is hereby corrected as shown below:

Column 1, line 12, "Publication No. 2005/02249999" s/b "Publication No. 2005/0224999"

Column 5, line 14, change "1a" to --11a--

Column 12, line 10, change "mass" to --Mass--

Signed and Sealed this

Ninth Day of February, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,592,277 B2
APPLICATION NO. : 11/130269
DATED : September 22, 2009
INVENTOR(S) : Anthony L Andrady et al.

It is certified that error appears in the above-identified patent and that said Letters Patent is hereby corrected as shown below:

Column 12, line 10, change "Mass" to "MA"

Signed and Sealed this

Fifth Day of October, 2010

David J. Kappos

David J. Kappos
*Director of the United States Patent and Trademark Office*